US005552566A

United States Patent [19]

Lin et al.

[11] Patent Number: 5,552,566

[45] Date of Patent: Sep. 3, 1996

[54] APPARATUS FOR PREVENTING CORONAL DISCHARGE

[75] Inventors: Wei-Chung Lin, Birmingham; William D. Caldwell, Bessemer; John W. Cundiff, Hueytown, all of Ala.

[73] Assignee: Reliable Bethea Power Products, Pelham, Ala.

[21] Appl. No.: 169,016

[22] Filed: Dec. 20, 1993

[51] Int. Cl.[6] ..... H01T 19/00

[52] U.S. Cl. ..... 174/144; 174/140 CR; 174/140 R

[58] Field of Search ..... 174/140 CR, 140 R, 174/144, 140 H, 141 R, 149 R, 150, 127, 140 S, 141 C

[56] References Cited

U.S. PATENT DOCUMENTS

| | | | |
|---|---|---|---|
| 1,709,697 | 4/1929 | Wahlberg | 174/141 R |
| 4,255,615 | 3/1981 | Huang et al. | 174/140 CR |
| 4,771,292 | 9/1988 | Beach et al. | 174/140 CR X |

FOREIGN PATENT DOCUMENTS

| | | | |
|---|---|---|---|
| 0220210 | 8/1961 | Austria | 174/141 R |
| 0888977 | 12/1943 | France | 174/140 R |

*Primary Examiner*—Hyung S. Sough
*Attorney, Agent, or Firm*—Veal & Marsh

[57] ABSTRACT

An improved apparatus for deconcentrating an electric field surrounding a high voltage insulator. A clamp assembly centrally formed within a coronal ring permits positive placement of the coronal ring about an insulator end fitting. The clamping assembly comprises an integral clamp with a u-shaped opening for engaging a cylindrical portion of an insulator end fitting. A keeper clamp mounts superjacent to the integral clamp and a smaller second u-shaped opening engages a portion of the insulator end fitting having a smaller diameter. A captive fastener such as a bolt extends upwardly through the clamp and keeper clamp to secure the keeper clamp in position against the insulator end fitting and the integral clamp to secure the corona ring in position relative the insulator end fitting and sheds. The varied sized openings of the clamp and keeper clamp prevent inverted installation of the corona ring.

12 Claims, 3 Drawing Sheets

APPARATUS FOR PREVENTING CORONAL DISCHARGE

FIELD OF THE INVENTION

This invention relates to an attachment for preventing coronal discharge in high voltage insulators. In greater particularity the invention relates to a coronal ring with a positive clamping means which allows for mounting the ring to a polymer insulator end fitting. In even greater particularity, the positive clamping means utilizes a single fastener for ease of installation especially in hot line situations.

BACKGROUND OF THE INVENTION

Corona is a discharge caused by electrical overstress in insulating materials. The occurrence of corona is often associated with the electrical failure of the insulator or insulating materials. In solids the occurrence of corona can result in the deterioration of the insulating material.

In high voltage transmission lines, the insulating material in which coronal discharge occurs is the air surrounding the conductor or insulators of the transmission line hardware. Thus, in the context of transmission lines corona has been described by the American Standards Association as: a luminous discharge due to ionization of the air surrounding a conductor around which exists a voltage gradient exceeding a certain critical value. These discharges occur as the electrons from the intense electric field surrounding the conductor exceed a critical value. Normally, the electrons collide with air molecules such as oxygen or nitrogen and the electron bounces off with no transfer of energy to it. However, when the intensity of the electron exceeds a critical value the velocity of the electron is such that its collision with the air molecules is inelastic. Thus, an electron is knocked from an outer shell of the air molecules ionizing these molecules. The molecule with the missing ion is now a positive ion. The positive ions, e.g. nitrogen ions, are attracted towards the negative conductor in a sluggish manner due to their large size. These ions manage to capture free electrons which results in a quanta of energy being released as the energy level of a neutral molecule is less than that of the positive ion. The energy is radiated as an electromagnetic wave in the visible light range from the recombining of nitrogen ions with free electrons.

The coronal discharges result in deterioration of synthetic materials comprising insulators on transmission lines. The discharges also result in the loss of efficiency in transmitting current along such hardware and radio disturbances or interference caused such discharges. Increased expenses in the form of replacement insulators and related labor are also a result of coronal discharge.

In the past, numerous shielding and ring devices have been disclosed which spread and deconcentrate the electric field surrounding conductors and insulators to prevent coronal discharge. The majority of the control devices use some type of transverse mounting means such as a suspension clamp or a yoke plate connected to a suspension clamp to hold the control devices in place. These mounting means are complex to manipulate and utilize numerous pieces such as fasteners and u-shaped clamps. The manipulation of complicated mounting means makes installing and removing the control devices difficult for the line worker. Line workers are in a precarious work environment high in the air where the manipulation of mounting means increases the length of time it takes to complete a job. Should one of the pieces become completely disengaged and fall to the ground, the line worker must have a replacement piece handy or retrieve the missing piece to complete the job. Occasions may arise wherein the control devices must be installed or removed in a hot line situation and the added manipulation of the mounting means increases the risk of injury to the line worker. There is a need in the transmission line hardware for a corona control device or ring which has a mounting apparatus for simple installation and removal of the device.

Placement of control devices relative to the end fittings and weather sheds of the polymer insulator end fitting is extremely critical for the device to perform properly. Field calculations and laboratory tests are conducted to determine the precise location of the control devices for particular transmission hardware at a rated voltage. However, it is the line worker and not the engineer who installs the control device on the insulator end fitting. Though competent and fully trained, it is possible for a line worker to install many of the existing control devices in an inverted manner which results in improper positioning of the ring or shield. Improper installation can lead to ineffective control as position of the ring is critical and degradation of insulator material may result. There is a need for in the transmission line industry for a control device such as a shield or ring which prevents inverted installation by a line worker.

SUMMARY OF THE INVENTION

It is an object of this invention to provide an apparatus for preventing coronal discharge in high voltage transmission insulators.

Another object of this invention is to provide an apparatus for preventing coronal discharge which can be mounted in only one position to prevent inverted installation of the apparatus.

Still another object of this invention is to provide an apparatus for preventing coronal discharge which utilizes a single fastener for ease in installation and removal in hot line situations.

These and other objects of this invention are accomplished through the use of a coronal ring with a side opening, positive placement clamping means which prevents the inverted installation of the corona ring to an insulator end fitting of a high voltage transmission line insulators,

BRIEF DESCRIPTION OF THE DRAWINGS

Apparatus embodying features of the present invention are depicted in the accompanying drawings which form a portion of this disclosure and wherein.

Figure 1:
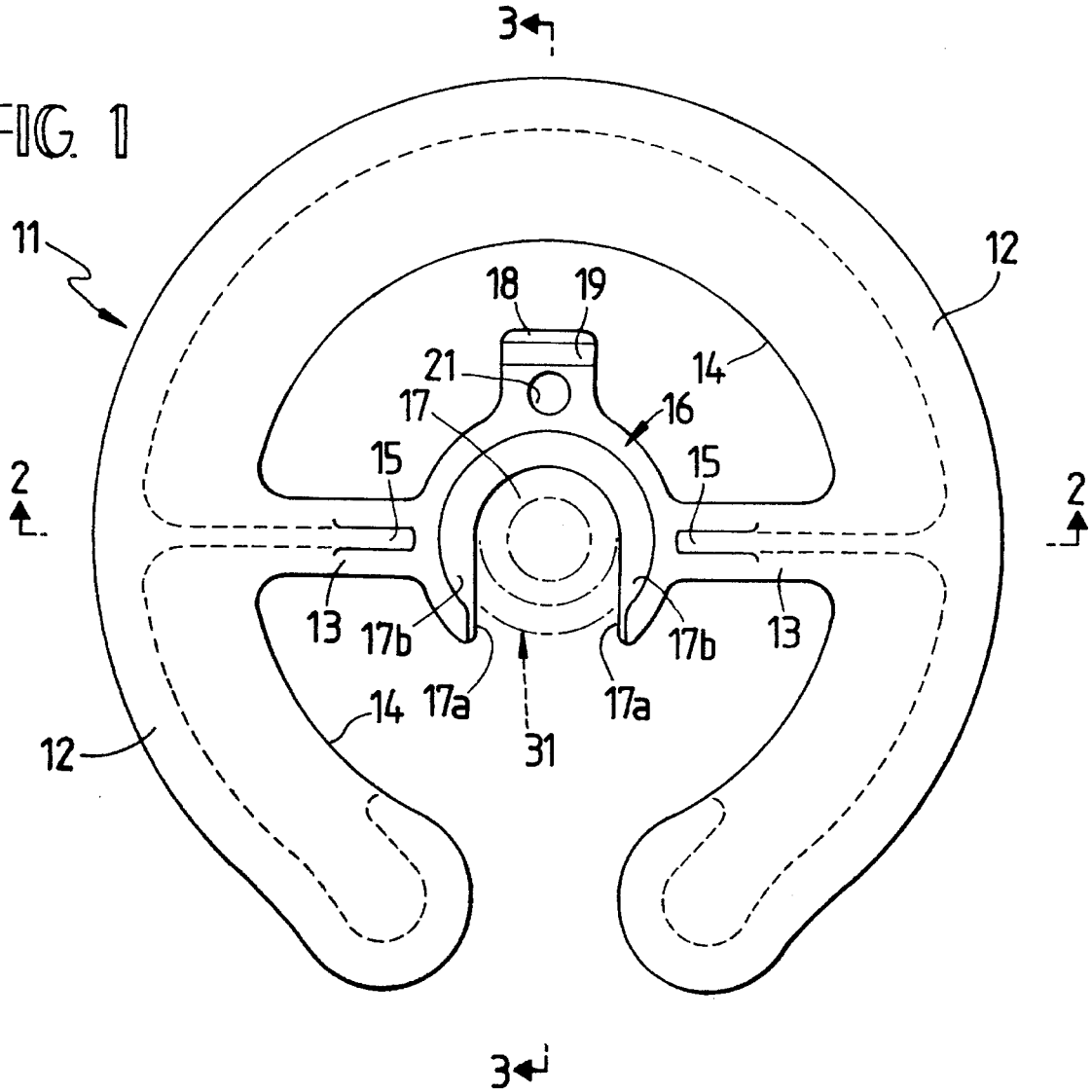
FIG. 1 is a top plan view of the corona ring assembly.
Figure 5:
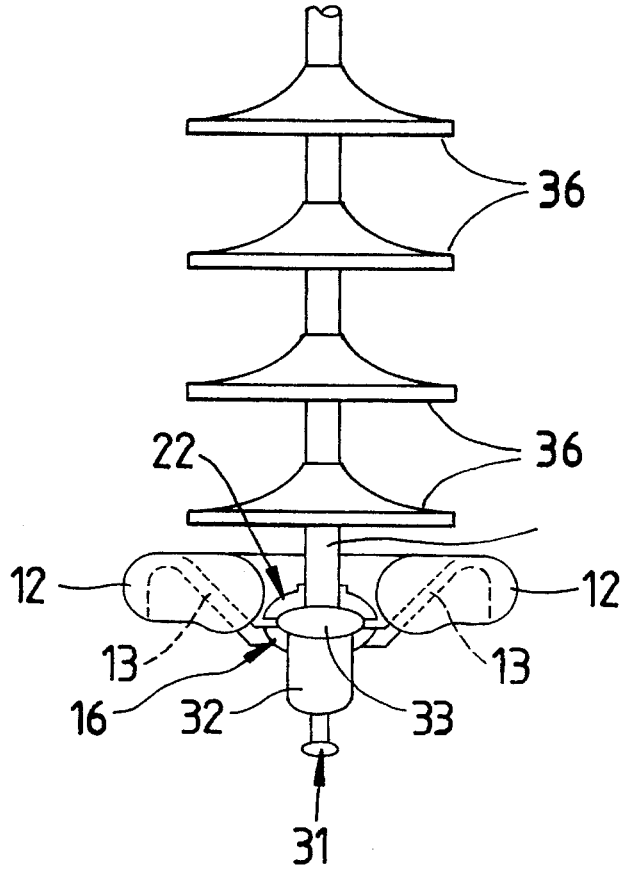
Figure 6:
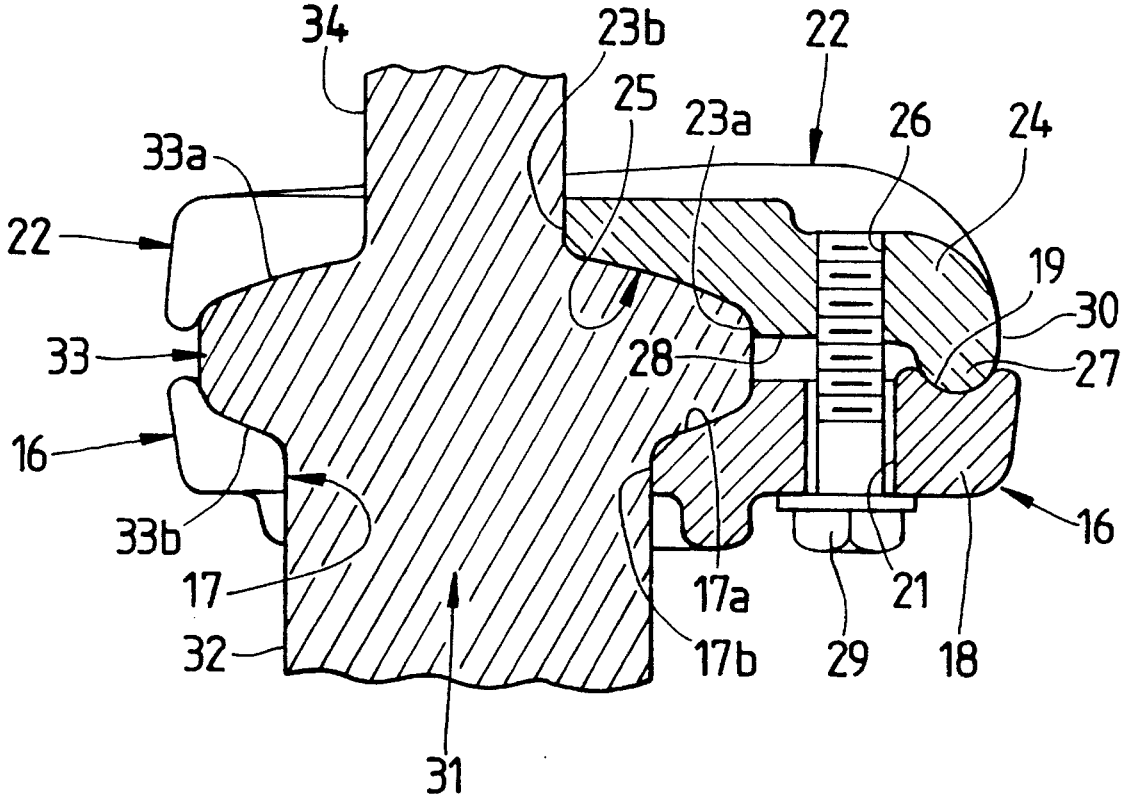

FIG, 3 is a sectional view of the corona ring and keeper element taken along lines 3—3 of FIG. 1;

FIG, 4 is an exploded perspective view of the ring, insulator end fitting and keeper element;

FIG. 5 is a side elevational view of the coronal ring assembly in place on an insulator end fitting; and FIG. 6 is a sectional view of the clamping means of the corona ring about an insulator end fitting.

DESCRIPTION OF THE PREFERRED EMBODIMENT

Figure 2:
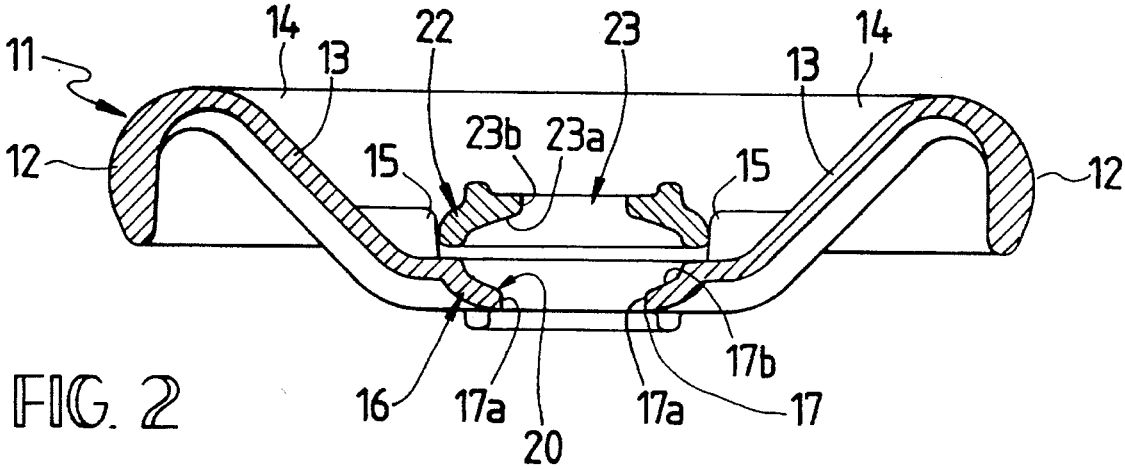
FIG. 2 is a sectional view of the corona ring and keeper element taken along lines 2—2 of FIG. 1.
Figure 4:
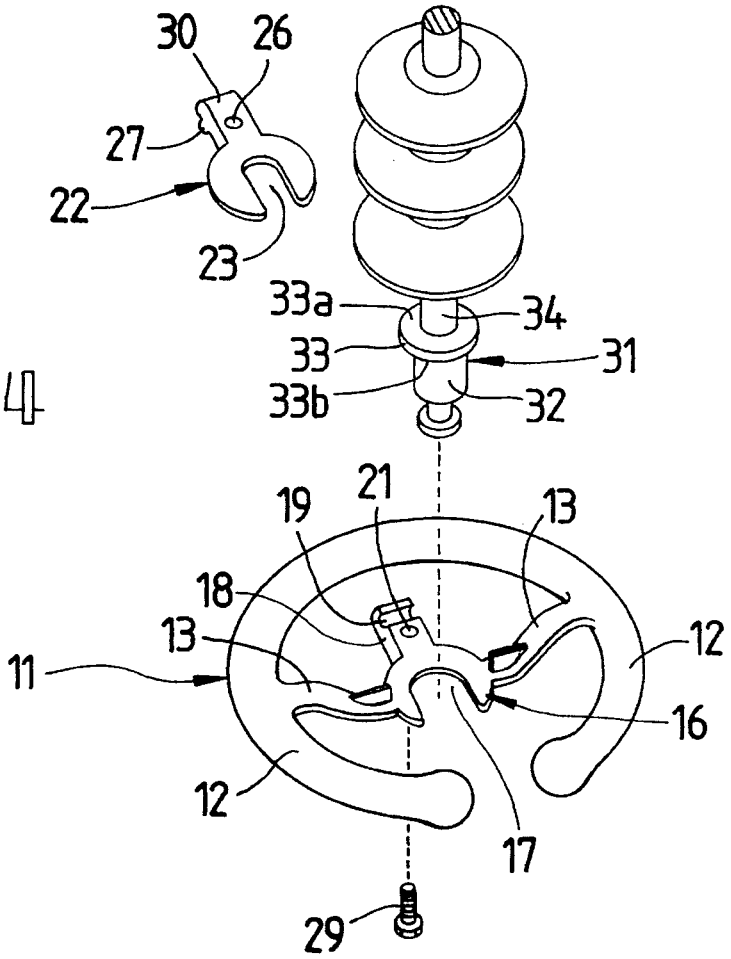

Referring to the drawings for a clearer understanding of the invention a corona ring assembly 11 is shown in FIG. 1. The ring assembly 11 comprises a metallic substantially circular ring 12 which has an open area subtending a defined arc therein. A bisecting integral cross member 13 connects the inner walls 14 of the ring 12. The cross member 13 angles downwardly from the inner edge 14 of the ring 12 as is best seen in FIG. 2. The cross member 13 forms an integral clamp seat 16. The integral clamp seat 16 further defines a u-shaped receiving channel 17 and an opposing tab member 18. Receiving channel 17 is defined by curved walls 17*a* and parallel side walls 17*b* which are spaced from each other a distance sufficient to receive therebetween an insulator end fitting 31 on which is formed an annular bell 33. Such end fittings 31 are formed with a major diameter shank 32 on one side of the bell 33 and a minor diameter shank 34 on the other side of the bell 33 as shown in FIG. 4. It is critical to the proper function of this invention that the insulator end fitting 31 have such major and minor diameters.

Referring to FIG. 6, the clamp seat 16 is further defined by a flared surface 20 which extends from the receiving channel 17, radially in relation to the curved wall 17*a* and outward from the side walls 17*b* such that the surface 20 defines an enlarged receiving channel which can receive the bell 33 of the insulator end fitting 31. Receiving channel 17 opens toward and is aligned with the open segment of ring 12.

Tab member 18 extends from the seat 16 in the direction opposite from the opening of receiving channel 17. A groove 19 is formed across the upper surface of the tab member 18 and an aperture 21 is defined through the tab member 18 intermediate the groove 19 and seat 16.

Figure 3:
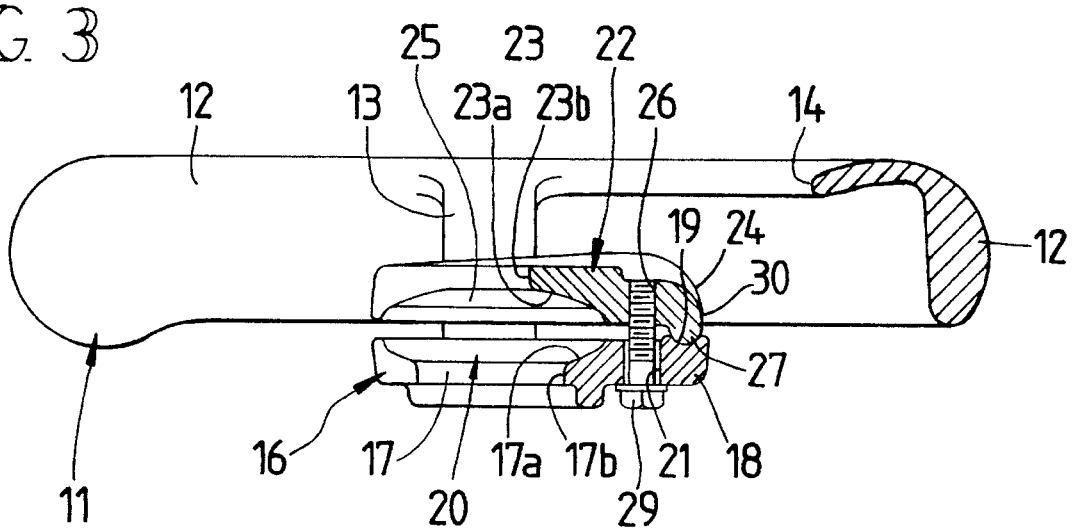

A keeper element 22 defines a u-shaped opening 23 which is of a smaller dimension than the receiving channel 17 of clamp seat 16 such that only the minor diameter portion 34 of end fitting 31 can be received therein. The keeper element 22 defines a u-shaped opening 23 having curved walls 23*a* and parallel side walls 23*b*. The distance between side walls 23*b* is less than that in the receiving channel 17 of clamp seat 16 such that only the minor diameter 34 of end fitting 31 is received between side walls 23*b*. A surface 25 extends downwardly and outwardly from opening 23 to accommodate the upper surface 33*a* of bell 33. A keeper tab 24 extends from the rear of the keeper element in alignment with tab 18. A threaded aperture 26 extends through the tab 24 intermediate the opening 23 and a rear edge 30 of keeper tab 24 in alignment with aperture 21. The keeper tab 24 has a ridge 27 transversely extending across the lower surface 28 thereof. The ridge 27 cooperatively engages the groove 19 of tab member 18 of the clamp seat 16 as shown in FIG. 3. A single retaining fastener 29 such as a threaded bolt extends upward through aperture 21 and engages aligned threaded aperture 26 to urge the keeper element 22 in position against the integral clamp seat 16. The keeper element 22 is prevented from rotational movement by defining walls 15 which rise from cross member 13 as best seen in FIG. 2. It should be noted that the single fastening bolt aids in the installation and removal of the ring assembly 11 in hot line situations because the line worker need not manipulate numerous fasteners or related pieces.

Referring now to FIG. 4, the ring assembly is shown being installed to an insulator end fitting 31. Parallel walls 17*b* of receiving channel 17 engage the major diameter portion 32 of end fitting 31 just below a bell 33 formed on the end fitting. Curved walls 17*a* accommodate the lower surface 33*b* of annular bell 33. The parallel walls 23*a* of u-shaped opening 23 engage the minor diameter portion 34 of the end fitting 31 above the annular bell 33. Surface 25 accommodates the upper surface 33*a* of annular bell 33 of end fitting 31. The fastening bolt 29 urges the keeper element 22 against the integral clamp seat 16 in a position about bell 33 as shown in FIG. 6. Note that the ring assembly 11 can only be placed on the insulator end fitting 31 in one and only one position, thereby preventing inverted installation and thus insuring that the distance of the ring assembly from a conductor is correct to prevent coronal discharge.

While I have shown my invention in but one embodiment it will be obvious to those skilled in the art that it is not so limited, but is susceptible of various changes and modifications without departing from the spirit thereof.

We claim:

1. An apparatus for deconcentrating an electric field surrounding a high voltage insulator comprising:

a corona ring; and a clamp assembly for mounting said corona ring to an insulator end fitting of a high voltage insulator said clamp assembly for engaging an annular bell on said insulator end fitting wherein said clamp assembly further comprises an integral cross member connecting interior edges of said corona ring, said integral cross member forming a clamp seat at a central portion of said cross member, said cross member defining a first u-shaped opening therein, a keeper clamp cooperatively mounted to said clamp seat, said keeper clamp defining a second u-shaped opening aligned with said first u-shaped opening, said second u-shaped opening being of a dimension smaller than said first u-shaped opening, and fastening means for securing said keeper clamp subjacent said clamp seat, wherein said second u-shaped opening is capable of receiving said insulator end fitting only on one side of said bell.

2. An apparatus as defined in claim 1 wherein said first u-shaped opening is defined by a pair of parallel walls for engaging a major diameter of said insulator end fitting, said clamp seat defining a surface which extends outwardly from said first u-shaped opening to accommodate a first surface of said annular bell of said insulator end fitting.

3. An apparatus as defined in claim 1 wherein said second u-shaped opening comprises a pair of parallel walls for engaging a minor diameter of said insulator end fitting formed on one side of said annular bell, said keeper clamp defining a surface which extends outwardly from said second u-shaped opening to accommodate a second surface of said annular bell of said insulator end fitting.

4. An apparatus as defined in claim 1 wherein said keeper clamp has a tab member extending away from said second opening, said tab member defining thereon a transverse ridge extending along a lower surface of said tab member perpendicular to said second u-shaped opening, wherein said clamp seat has a second tab member extending away from said first u-shaped opening, said second tab member defining a groove along an upper surface of said second tab member perpendicular to said first u-shaped opening for receiving said ridge therein.

5. An apparatus as defined in claim 1 wherein said fastening means is a bolt which extends upwardly through said clamp seat and said keeper clamp through co-aligned apertures defined therein to urge said clamp seat and keeper clamp together.

6. An apparatus for deconcentrating an electric field surrounding a high voltage insulator comprising a corona ring having a integral cross member connecting inner edges of said ring, said cross member forming a clamp seat at a center said ring, said clamp seat defining a first u-shaped opening therein, a keeper clamp mounted adjacent said clamp seat, said keeper clamp defining an aligned second u-shaped opening of a dimension lesser than said first u-shaped opening, and a fastener retaining said keeper clamp adjacent said clamp seat, such that said first and second u-shaped openings receive therewithin an insulator end fitting on a high voltage insulator having a major and minor diameter.

7. An apparatus as defined in claim 6 wherein said first u-shaped opening is defined by a pair of parallel walls for engaging said major diameter of said insulator end fitting, said clamp seat defining a surface which extends outwardly from said first u-shaped opening to accommodate a first surface of an annular bell of said insulator end fitting.

8. An apparatus as defined in claim 6 wherein said second u-shaped opening comprises a pair of parallel walls for engaging a minor diameter of said insulator end fitting, said keeper clamp defining a surface which extends outwardly from said second u-shaped opening to accommodate an opposite surface of an annular bell of said insulator end fitting.

9. An apparatus as defined in claim 6 wherein said keeper clamp has a first tab member extending opposite said second u-shaped opening, said first tab member defines a ridge extending along the lower surface of said first tab member perpendicular to said second u-shaped opening, said clamp seat having a second tab member extending opposite said first u-shaped opening, said second tab member defining a groove extending along an upper surface of said second tab member perpendicular said first u-shaped opening, said ridge cooperatively engaging said groove when said keeper clamp is mounted adjacent said clamp seat.

10. An apparatus as defined in claim 9 wherein said keeper clamp is secured to said clamp seat by a single fastener which extends upwardly through said clamp seat and said keeper clamp.

11. An apparatus as defined in claim 10 wherein said fastener is a bolt extending upwardly through said clamp seat and said keeper clamp to retain said keeper clamp adjacent said clamp seat.

12. An apparatus for deconcentrating an electric field surrounding a high voltage insulator comprising a corona ring having an integral cross member connecting inner edges of said ring, said cross member forming a clamp seat at a center of said ring, said clamp seat defining a first u-shaped opening and having a tab member extending rearwardly from said first u-shaped opening, said first u-shaped opening further comprising a pair of parallel walls for engaging a major diameter of an insulator end fitting, said clamp seat defining curved walls extending upwardly from said first u-shaped opening to accommodate a first surface of an annular bell of said insulator end fitting, said tab member defining a groove along an upper surface of said tab member perpendicular to said first u-shaped opening, a keeper clamp mounted adjacent said clamp seat, said keeper clamp defining an aligned second u-shaped opening of a dimension lesser than said first u-shaped opening, said second u-shaped opening comprising a pair of parallel walls for engaging a minor diameter of said insulator end fitting, said keeper clamp defining a surface outwardly extending from said second u-shaped opening to accommodate an opposite surface of said annular bell of said insulator end fitting, a fastener retaining said keeper clamp adjacent said clamp seat, said keeper clamp having a tab extending rearwardly therefrom and opposite said second u-shaped opening, said tab defining a ridge perpendicular to said second u-shaped opening, said ridge cooperatively engaging said groove of said tab member when said keeper clamp is secured adjacent said clamp seat via said fastening member.

* * * * *